US006265359B1

(12) United States Patent
Parthiban et al.

(10) Patent No.: US 6,265,359 B1
(45) Date of Patent: Jul. 24, 2001

(54) IMIDE-DIUREA AND IMIDE-URETHANE UREA GREASE THICKENERS AND ORGANIC SOLVENT FREE PROCESS FOR PREPARATION THEREOF

(76) Inventors: Anbanandam Parthiban, H. No. 2292, Sector-9; Kanta Prasad Naithani, H. No. 188, Sector-8; Akhilesh Kumar Bhatnagar, H. No. 205, Sector-7A, all of Faridabad 121006. (IN)

( * ) Notice: Subject to any disclaimer, the term of this patent is extended or adjusted under 35 U.S.C. 154(b) by 0 days.

(21) Appl. No.: 09/487,592

(22) Filed: Jan. 19, 2000

(51) Int. Cl.[7] ..... C10M 115/08

(52) U.S. Cl. ..... 508/291; 508/232; 508/240; 508/464; 508/552

(58) Field of Search ..... 508/291, 232, 508/240, 464, 552

(56) References Cited

U.S. PATENT DOCUMENTS 3,346,497 * 10/1967 Dreher et al. .
3,689,413 * 9/1972 Loeffler .
4,100,080 * 7/1978 Adams .
4,759,859 * 7/1988 Waynick .

* cited by examiner

*Primary Examiner*—Jerry D. Johnson
(74) *Attorney, Agent, or Firm*—Venable; George H. Spencer; Ashley J. Wells

(57) ABSTRACT

An organic solvent free process for the preparation of a grease thickener which is at least one of an imide-diurea and an imide-urethane urea includes (a) providing approximately equimolar amounts of reagents including dibasic acid selected from the group consisting of succinic acid, glutaric acid, phthalic acid, and anhydrides thereof, reactant selected from the group consisting of a primary diamine and a primary amino hydroxy compound, and having 2 to 10 carbon atoms, toluene diisocyanate, and primary monoamine having 8 to 22 carbon atoms; (b) reacting the dibasic acid with the reactant to provide a first reaction mixture; (c) reacting the first reaction mixture with the toluene diisocyanate to provide a second reaction mixture; and (d) reacting the second reaction mixture with the primary monoamine to provide said grease thickener.

17 Claims, No Drawings

IMIDE-DIUREA AND IMIDE-URETHANE UREA GREASE THICKENERS AND ORGANIC SOLVENT FREE PROCESS FOR PREPARATION THEREOF

BACKGROUND OF THE INVENTION

1. Field of the Invention

This invention relates to imide-diurea and imide-urethane urea grease thickeners made in situ as a one pot preparation involving a sequential reaction but without making use of any organic solvents.

2. Description of the Related Art

Grease is a semi-fluid medium comprised of a liquid lubricant and a thickener. The liquid lubricant is derived from natural mineral oils, synthetic hydrocarbons, esters, ethers, polysiloxanes, fluorocarbon polymers etc. A wide variety of compounds are used as thickeners. For example mineral oils are thickened by alkali or alkaline earth metal soaps of fatty acids, clays, polymers, phthalocyanines, organic dyes, polyureas and others. The most commonly used thickners are those containing lithium, calcium, or sodium salts of natural fatty acids. At present, lithium soaps of stearic acid and 12-hydroxy stearic acid is commonly used. Imide-urea thickeners have also been used, as disclosed in JP 79 114 506, in which acetone, a volatile organic solvent is used to dissolve the starting materials. U.S. Pat. No. 5,585,335 describes the use of a metal salt based on imide-carboxylic acid in combination with a bi-metal phthalate complexing agent. JP 57 109 896 discloses lubricating greases manufactured by compounds containing 4 to 8 imide groups per molecule, in which the starting materials are dissolved in N,N-dimethyl formamide, a non-volatile, high-boiling organic solvent. JP 56 139 592 discloses lubricating oils thickened by two imide and two amide groups per molecule in which acetone is used as a carrier for the anhydride and the amine. Another Japanese patent publication JP 54 113 605 discloses a lubricating grease thickened with an imide compound, in which acetone is used to dissolve the anhydride and amino compounds.

An object of this invention is to propose a process for the preparation of imide-diurea and imide-urethane urea grease thickeners.

Another object of this invention is to propose a process for the preparation of imide-diurea and imide-urethane urea grease thickeners which avoids the use of volatile or non-volatile, low-boiling or high-boiling organic solvent.

Still another object of this invention is to propose a process for the preparation of imide-diurea and imide-urethane urea grease thickeners which avoids the difference in reactivity of the reactants employed and to maximize the formation of products capable of thickening the oil of lubricating quality.

A further object of this invention is to propose a process for the preparation of imide-diurea and imide-urethane urea grease thickeners which exhibits excellent storage stability without showing any age hardening tendency.

A still further object of this invention is to propose a grease and a grease thickening system.

SUMMARY OF THE INVENTION

According to this invention there is provided a process for the preparation of imide-diurea and imide-urethane urea grease thickeners comprising in reacting a dibasic acid selected from the group consisting of succinic acid, maleic acid, glutaric acid, and phthalic acid and anhydrides thereof, with a reactant selected from a primary diamine and a primary amino hydroxy compound having 2 to 10 carbon atoms followed by the reaction with toluene diisocyanate and, thereafter, with a primary monoamine having 8 to 22 carbon atoms.

DESCRIPTION OF THE PREFERRED EMBODIMENTS

The use of a solvent-free process as employed in this invention has several advantages. The solvent, if it were volatile or low-boiling will not be let-off into the atmosphere. If the solvent were non-volatile or high-boiling it should be removed from the grease for which purpose the grease kettle is modified with provisions such as vacuum, since the presence of solvent will alter the consistency of the grease.

The sequential addition of reactants as followed in this invention provides a smooth grease of required consistency. Since the reactivity of isocyanate group is far greater than that of an anhydride moiety, in the presence of both of these functional groups, another reactive functional group would preferentially react with the former than the latter. Thus, when an aminohydroxy compound and a primary amine are present in a mixture consisting of an isocyanate and an anhydride, it would result in urea and urea-ester rather than urethane. The thickening efficiency of urea-ester would be questionable. Thus, the sequential addition of reactants accommodates the reactivity differences and hence minimizes the number of products formed, thereby resulting in products capable of thickening the oil.

The fatty monoamine employed in this invention helps to formulate a grease of excellent storage stability and also to prevent age-hardening.

The invention relates to imide-diurea and imide-urethane urea grease thickeners. By imide-diurea or imide-urethane urea is meant a grease thickening compound having imide-urea and imide-urethane urea chemical functionality useful for forming a grease when added in an effective amount to a liquid lubricant such as a hydrocarbon oil and particularly to a hydrocarbon oil of lubricating quality.

Imide-diurea and imide-urethane urea useful as thickeners in the practice of this invention include one or more organic compounds which comprise a reaction product of diacid or anhydride, diamine or amino-hydroxy compound, toluene diisocyanate and a monoamine. These ingredients when added in a sequence to a hydrocarbon oil having lubricating quality, at high temperature, result in a grease exhibiting high dropping point, good mechanical sheal stability, superior water resistance, excellent corrosion and rust inhibiting characteristics, better oxidation stability and prolonged service life in high temperature life performance test.

The thickener of this invention comprises an imide-diurea or imide-urethane-urea compound which is the product of a sequence of reactions involving a diabasic acid selected from succinic acid, maleic acid, glutaric acid and phthalic acid and anhydrides thereof, a primary diamine having a straight or branched, cylic or acyclic saturated or unsaturated hydrocarbon radical with 2 to 10 carbon atoms, or saturated/unsaturated primary amino hydroxy compound of 2 to 10 carbon atoms, toluene diisocyanate which is selected from at least one of the groups consisting of 2,4-toluene diisocyanate and 2,6-toluene diisocyanate, 2,4-toluene diisocyanate containing a minor amount of 2,6-toluene diisocyanate is commercially available, and a primary monoamine consisting of 8 to 22 carbon atoms which may be saturated or unsaturated, cyclic or acyclic.

The reaction between the dibasic acid or anhydride and the primary amine is carried out while the mole ratio of the dibasic acid or anhydride to the primary diamine is adjusted to 0.9 to 1:1. The reaction conditions are atmospheric pressure and a temperature of 80° to 220° C. The proportion of dibasic acid or anhydride to that of primary diamine, is adjusted according to the nature of the diamine. If the diamine employed is a liquid of low boiling point then the amount of dibasic acid or anhydride is reduced by 5 to 10 weight % in order to prevent the sublimation of dibasic acid or anhydride.

The reaction products obtained by heating 0.9 to 1 mole of the aforementioned succinic acid, maleic acid, glutaric acid, phthalic acid or the anhydrides thereof and one mole of straight or branched, cyclic or acyclic saturated or unsaturated primary diamine with 2 to 10 carbon atoms, or one mole of saturated or unsaturated, straight or branched, cyclic or acyclic primary amino hydroxy compound of 2 to 10 carbon atoms are imide compounds with one free primary amino or hydroxyl group. The imide compounds are obtained as solids dispersed in the oil. As stated above, the reaction is carried out at atm. pressure at a temperature of 80° to 220° C. After this step, the reaction mixture is cooled down to 100° C. to 180° C., preferably to 100° C. to 160° C., most preferably to 110° to 150° C. and one mole of toluene diisocyanate which is a mixture of 2,4- and 2,6-isomers is added followed by one mole of branched or unbranched, saturated or unsaturated, cyclic or acyclic primary monoamine of 8 to 22 carbon atoms, preferably 10 to 22 carbon atoms and most preferably 12 to 22 carbon atoms. The mixture was stirred for 1 to 4 hours at 140° C. to 200° C., preferably at 150° to 200° C., most preferably at 160° to 200° C. at which period it resulted in a grease of high drop point.

The imide-diurea and imide urethane-urea compositions of the invention set forth above are effective thickeners with 7 to 30% by weight, preferably 10 to 30%, most preferably 13 to 25% by weight of the thickener being necessary to thicken the lubricating oil. The invention will be further understood with ref. to the examples below.

EXAMPLES

Examples 1

In this experiment 800 g of a paraffinic, hydrocarbon base oil having a viscosity of from 90 to 118 cSt at 40° C. and 9 to 12 cSt at 100° C. is placed in a stainless steel container. 42 g of phthalic anhydride, 26.4 g of 1,4-diamino butane were added to the container and the mixture was heated at 130° C. for 1 h in a heating mantle. Then the temperature was raised to 160° C. and held for 2 h. During this period, water, a product of condensation between the anhydride and the diamine was liberated. The temperature was then raised to 200° C. and held for 30 minutes. 400 g of oil was added and the contents were allowed to cool down to 140° C. Then 52.3 g of toluene diisocyanate, which is a mixture of 2,4- and 2,6-isomers was added followed by 80.8 g of stearyl amine. After 30 minutes the temperature was raised to 180° C. The brown, sticky, semi-solid dispersed in the container, slowly begins to thicken after mixing for a while at this temperature and the mixture was heated upto 200° C. The grease was then cooled down to ambient temperature and homogenized.

The final composition of the so called imide-diurea grease is set forth in Table 1 below:

TABLE 1

| | Total mass, g | Content, weight % |
|---|---|---|
| Paraffinic oil | 1200 | 85.62 |
| 1,4-diamino butane | 26.4 | 1.88 |
| Phthalic anhydride | 42 | 2.99 |
| Toluene diisocyanate | 52.3 | 3.73 |
| Stearyl amine | 80.8 | 5.76 |

Example 2

In this experiment, 800 g of the paraffinic base oil used in Example 1, is placed in a stainless steel container. Then 32.73 g of m-aminophenol and 44.4 g of phthalic anhydride were added to the container and the mixture was heated at 130° C. for 1 h in a heating mantle. Then the temperature was raised to 160° C. and held for 2 h. During this period, liberation of water was observed. Then the temperature was raised to 200° C. and held for 30 minutes. At this stage, 400 g of oil was added and the contents were allowed to cool down to 140° C. Toluene diisocyanate, a mixture of 2,4- and 2,6-isomers, 52.3 g was added followed by 80.8 g of stearyl amine. After 30 minutes the temperature was raised to 160° C. and held there for 30 minutes. At the end of this period, the temperature was raised to 180° C. The brown, sticky, semi-solid dispersed in the container begins to thicken into a grease after mixing for a while and heated further upto 200° C. The contents were then cooled down to ambient temperature and homogenized.

The final composition of this so formed imide urethane-urea grease is set forth in Table 2 below:

TABLE 2

| | Total mass, g | Content, weight % |
|---|---|---|
| Paraffinic oil | 1200 | 85.09 |
| m-Aminophenol | 32.7 | 2.32 |
| Phthalic anhydride | 44.4 | 3.15 |
| Toluene diisocyanate | 52.3 | 3.71 |
| Stearyl amine | 80.8 | 5.73 |

Test results

The test results of the greases prepared according to the foregoing examples are set forth in the Table 3 below:

| S.No. | Property | Test method ASTM/ IP | Examples 1 | Examples 2 |
|---|---|---|---|---|
| 1. | Mechanical stability at 25° C. | D217 | | |
| | i. worked penetration, 60 strokes | | 307 | 284 |
| | ii. after 100 000 strokes | | 367 | 432 |
| | iii. ii-i | | 60 | 148 |
| 2. | Drop point, ° C. | D2265 | 281 | 281 |
| 3. | Copper corrosion, 100° C.,24 h | IP-212 | pass | pass |
| 4. | Rust preventive properties | D1743 | pass | fail |
| 5. | Emcor | IP-220 | 0 | 1 |
| 6. | Water wash-out, 80° C., 1 h | D1264 | 3 | 5 |
| 7. | Roll stability, 2 h % change | D1831 | 18 | 17 |
| 8. | Roll stability, 10% water, 2 h, % change | | 16 | 29 |
| 9. | Four-ball weld load, Kg | IP-239 | 90 | 140 |
| 10. | Wear scar dia., mm | D2266 | 0.55 | 0.65 |
| 11. | Oxidation stability, 100 h, drop in psi | D942 | 2 | 2 |
| 12. | Evaporation loss | | 0.16 | 0.19 |
| 13. | Heat stability | | 1.02 | 2.63 |
| 14. | Life performance, 160° C., hrs | D3527 | 272 | 174 |

Imide-diurea (IDU) greases show better mechanical shear stability as such as well as in the presence of water compared to imide-urethane urea (IUU) greases. In the ASTM D217 standard grease worker, after 100 000 strokes, IDU grease softened by 60 units whereas IUU grease softened by 148 units. Similarly, in roll stability test in the presence of 10% water, IDU grease underwent 16% change in penetration while IUU experienced 29% change. The dropping point of both greases are high. IDU greases also possess better rust inhibiting characteristic in the dynamic and the static tests, IP 220 and modified ASTM D1743 respectively. While IUU grease gives a rating of 1 in the former test, it fails in the latter. Oxidation stability of both greases are good. IDU grease performs supremely in the life performance test, ASTM D3527.

From the data reported in Table 3, it is shown that IDU and IUU grease thickeners can be used to prepare better quality greases. The examples set forth are to illustrate, not to limit the invention, whereby those skilled in the art may understand more fully, the nature in which the present invention can be carried out effectively.

What is claimed is:

1. An organic solvent free process for the preparation of a grease thickener which is at least one of an imide-diurea and an imide-urethane urea, the process comprising the steps of:

a. providing approximately equimolar amounts of reagents comprised of:
dibasic acid selected from the group consisting of succinic acid, glutaric acid, phthalic acid, and anhydrides thereof,
reactant selected from the group consisting of a primary diamine and a primary amino hydroxy compound, and having 2 to 10 carbon atoms,
toluene diisocyanate, and
primary monoamine having 8 to 22 carbon atoms;

b. reacting said dibasic acid with said reactant at a temperature and for a time period effective for reaction thereof to provide a first reaction mixture;

c. reacting said first reaction mixture with said at least one toluene diisocyanate at a temperature and for a time period effective for reaction thereof to provide a second reaction mixture; and d. reacting said second reaction mixture with said primary monoamine at a temperature and for a time period effective for reaction thereof to provide said grease thickener, wherein said first reaction mixture contains at least one imide compound having one free group which is one of a primary amino group or an hydroxyl group so that the grease thickener has an imide group on only one end thereof, and wherein the reactions of steps (b), (c), and (d) take place by sequential addition of reagents so that reactivity differences are accommodated and number of products formed minimized.

2. The process according to claims 1, wherein said primary diamine is straight or branched, saturated or unsaturated, cyclic or acyclic, has 2 to 10 carbon atoms, and optionally contains at least one of N, O, S, or P.

3. The process according to claim 1, wherein said primary monoamine is straight or branched, saturated or unsaturated, cyclic or acyclic, and has 8 to 22 carbon atoms.

4. The process according to claim 3, wherein said primary monoamine has from 10 to 22 carbon atoms.

5. The process according to claim 4, wherein said primary monoamine has from 12 to 22 carbon atoms.

6. The process according to claim 1, wherein said primary amino hydroxy compound is straight or branched, saturated or unsaturated, cyclic or acyclic, and has 2 to 10 carbon atoms, and wherein said primary monoamine is straight or branched, saturated or unsaturated, cyclic or acyclic, and has 8 to 22 carbon atoms.

7. The process according to claim 6, wherein said primary monoamine has 10 to 22 carbon atoms.

8. The process according to claim 7, wherein said primary monoamine has 12 to 22 carbon atoms.

9. The process according to claim 1, wherein, in step (b), from 0.9 to 1 mole of said dibasic acid is reacted with one mole of said reactant to provide said first reaction mixture, and wherein step (b) further comprises heating the first reaction mixture to a temperature ranging from 80 to 220° C. at atmospheric pressure.

10. The process according to claim 9, wherein heating in step (b) is to a temperature greater than 100° C., and wherein the process further comprises cooling the first reaction mixture to a temperature ranging from 100 to 180° C. to provide a cooled first reaction mixture after step (b) and prior to step (c).

11. The process according to claim 10, wherein the first reaction mixture is cooled to a temperature ranging from 100 to 160° C.

12. An organic solvent free process for the preparation of a grease thickener which is at least one of an imide-diurea and an imide-urethane urea, the process comprising the steps of:

a. providing approximately equimolar amounts of reagents comprised of:
dibasic acid selected from the group consisting of succinic acid, glutaric acid, phthalic acid, and anhydrides thereof,
reactant selected from the group consisting of a primary diamine and a primary amino hydroxy compound, and having 2 to 10 carbon atoms,
toluene diisocyanate which is a mixture of 2,4- and 2,6-isomers, and
primary monoamine having 8 to 22 carbon atoms;

b. reacting from 0.9 to 1 mole of said dibasic acid with one mole of said reactant by heating to a temperature ranging from 100 to 220° C. at atmospheric pressure for a time period effective for reaction thereof to provide a first reaction mixture;

c. cooling the first reaction mixture to a temperature ranging from 100 to 180° C. to provide a cooled first reaction mixture;

d. reacting said cooled first reaction mixture with one mole of said toluene diisocyanate to provide a second reaction mixture; and e. reacting said second reaction mixture with one mole of said primary monoamine at a temperature and for a time period effective for reaction thereof to provide said grease thickener.

13. The process according to claim 12, wherein said primary monoamine has 10 to 22 carbon atoms.

14. The process according to claim 13, wherein said primary monoamine has 12 to 22 carbon atoms.

15. The process according to claim 12, wherein said second reaction mixture and said one mole of said primary monoamine of step (e) are stirred for a period ranging from 1 to 4 hours at a temperature ranging from 140° to 200° C.

16. An organic solvent free process for the preparation of a grease thickener which is at least one of an imide-diurea and an imide-urethane urea, the process comprising the steps of:

a. providing approximately equimolar amounts of reagents comprised of:
   dibasic acid selected from the group consisting of succinic acid, glutaric acid, phthalic acid, and anhydrides thereof,
   reactant selected from the group consisting of a primary diamine and a primary amino hydroxy compound having 2 to 10 carbon atoms,
   toluene diisocyanate, and
   primary monoamine having 8 to 22 carbon atoms b. reacting from 0.9 to 1.0 mole of said dibasic acid with one mole of said reactant at a temperature effective for reaction ranging from 80 to 220° C. at atmospheric pressure to provide a first reaction mixture;

c. reacting said first reaction mixture with one mole of said toluene diisocyanate at a temperature effective for reaction thereof to provide a second reaction mixture; and d. reacting said second reaction mixture with one mole of said primary monoamine at a temperature effective for reaction thereof to provide the grease thickener, wherein said first reaction mixture contains at least one imide compound having one free group which is one of a primary amino group or an hydroxyl group so that the grease thickener has an imide group on only one end thereof, and wherein the reactions of steps (b), (c), and (d) take place by sequential addition of reagents so that reactivity differences are accommodated and number of products formed minimized.

17. The process according to claim 16, wherein the temperature in step (b) is greater than 100° C., and wherein the process further comprises cooling said first reaction mixture to a temperature ranging from 100 to 180° C. to provide a cooled first reaction mixture after step (b) and prior to step (c).

* * * * *